US006564590B2

(12) United States Patent
Matsuda

(10) Patent No.: US 6,564,590 B2
(45) Date of Patent: May 20, 2003

(54) KNITTED-IN SLIDE FASTENER

(75) Inventor: Yoshio Matsuda, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/158,524

(22) Filed: May 29, 2002

(65) Prior Publication Data

US 2002/0184926 A1 Dec. 12, 2002

(30) Foreign Application Priority Data

Jun. 8, 2001 (JP) ..... 2001-174521

(51) Int. Cl.[7] ..... D04B 23/14
(52) U.S. Cl. ..... 66/193; 66/195; 66/202
(58) Field of Search ..... 66/192, 193, 190, 66/195, 202, 170, 169 R, 171; 24/392, 393, 391

(56) References Cited

U.S. PATENT DOCUMENTS 5,502,986 A * 4/1996 Matsuda et al. ..... 66/193
5,540,064 A * 7/1996 Matsuda et al. ..... 66/193
5,615,563 A * 4/1997 Matsuda et al. ..... 66/193
5,688,594 A 11/1997 Lichscheidt et al.
5,794,460 A * 8/1998 Matsuda et al. ..... 66/193
5,857,359 A * 1/1999 Matsuda et al. ..... 66/193
6,006,552 A * 12/1999 Matsuda et al. ..... 66/193
6,148,643 A * 11/2000 Matsuda et al. ..... 66/193

FOREIGN PATENT DOCUMENTS

EP 0 399 708 A1 11/1990
EP 000688513 A2 * 6/1995 ..... 66/193
EP 000743025 A2 * 11/1996 ..... 66/193
EP 0 925 736 A2 6/1999
EP 1 048 238 A2 11/2000
JP 8-314 1/1996
JP 11-187909 7/1999

* cited by examiner

*Primary Examiner*—Danny Worrell
(74) *Attorney, Agent, or Firm*—Bell, Boyd & Lloyd LLC

(57) ABSTRACT

A knitted-in slide fastener comprising a continuous fastener element row which is knitted in at the same time as knitting of a fastener tape, wherein a fastener element mounting portion is knitted with a fixing knitting yarn for sandwiching and fixing upper and lower leg portions of each fastener element in a direction of front and rear of the fastener tape and other knitting yarns. Part of these composition yarns is composed of composite fiber yarns formed of heat shrinkage fiber material and heat fusion fiber material, and the heat shrinkage fiber material is shrunk by heat treatment and at the same time, the heat fusion fiber material is fused with other the composition yarns in the vicinity thereof. Consequently, no fraying occurs in yarns even if the composition yarn is cut out.

10 Claims, 7 Drawing Sheets

KNITTED-IN SLIDE FASTENER

BACKGROUND OF THE INVENTION

1. Field of the Invention

The present invention relates to a knitted-in slide fastener in which a fastener tape is composed of warp knitting structure and a continuous fastener element row which is of thermoplastic synthetic resin mono-filaments is knitted in and fixed along a fastener element mounting portion of a longitudinal side edge portion of the fastener tape at the same time. More particularly, the invention relates to a knitted-in slide fastener in which the knitting structure of the fastener element mounting portion is formed fine so as to stabilize a pitch between fastener elements and no fraying of composition yarns or separation of fastener element row occurs even when the composition yarn of the fastener element mounting portion is cut out by a sewing needle.

2. Description of the Related Art

For example, Japanese Patent Application Laid-Open No. 8-314 has disclosed a knitted-in slide fastener in which at the same time when a fastener tape is knitted, a continuous fastener element row is knitted in and fixed to a fastener element mounting portion formed along a side edge in the longitudinal direction of the fastener tape. In the knitted-in slide fastener disclosed in this publication, another chain knitting yarn is knitted in duplication in a needle loop group composed of fixing chain knitting yarns for the fastener element row which forms a row of wale near a fastener tape main body, so that a foundation structure in the fastener element mounting portion is formed fine by a chain knitting in which knitting pattern thereof is duplicated. Consequently, it is intended to stabilize the dimension of the fastener element mounting portion and fix the fastener element row firmly.

Japanese Patent Application Laid-Open No. 11-187909, for example, has disclosed technology for stabilizing the mounting of the fastener element row. According to the same publication, all the knitting yarns which compose the aforementioned fastener element mounting portion are provided with a higher heat shrinkage characteristic than that of knitting yarns which compose the fastener tape main body and after knitting, are subjected to heat processing, so that composition yarns of the fastener element mounting portion are allowed to shrink largely than the composition yarns of the fastener tape main body. Consequently, it is intended to form the fastener element mounting portion fine so as to tighten the fastener element row more tightly with the fixing chain knitting yarns thereby securing a high coupling strength.

The knitted-in slide fastener disclosed in the above-mentioned publication restricts an operating end of a slider by mounting an upper stop and a lower stop on both end portions thereof like an ordinary slide fastener. Because each of these upper and lower stops is composed of a small piece made of metallic material or synthetic resin material, mounting portions of the stops are protruded outside when such a slide fastener is sewed to trousers or skirt, so that its appearance is not good. Particularly, in case of the upper stops, which are mounted separately to the right and left, it is difficult to fit the slider to the upper stops, so that the fastener portion between the slider and the upper stops is open during use, thereby producing an inconvenience in appearance.

On the other hand, because the knitted-in slide fastener of the invention is excellent in plasticity in terms of the structure thereof as compared to the slide fastener formed of a woven fabric, it has been often employed in particularly plastic clothes. However, if the aforementioned stops are mounted, the inconvenience becomes remarkable. For the reason, since before, end portions of the fastener element row have been sewed directly to clothes through a sewing needle.

When it is intended to mount the fastener element row directly to clothes by sewing the end portions thereof with the sewing needle, the sewing needle should traverse the end portion of the fastener element row. Then, the sewing needle is pierced into the fixing knitting yarns existing at the fastener element mounting portion of the fastener tape or the other composition yarns existing at the same mounting portion located between respective fastener elements, so that the yarns pierced by the sewing needle is cut out. Consequently, by opening/closing operation or mechanical operation upon washing or the like of the slide fastener, fraying in yarn may occur in the fastener element mounting portion and part of the fastener element row may be separated from the fastener tape. Particularly, in the case that heat treatment such as thermal setting is carried out after manufacturing of a fastener stringer like the knitted-in slide fastener of the invention, the yarns are cut out easily due to interference with said sewing needle because hardness and tension of the yarn itself are heightened. Further particularly, if a yarn having a small-diameter in which plasticity is regarded important is used, the yarn is more highly inclined to be cut out.

SUMMARY OF THE INVENTION

Accordingly, the present invention has been achieved to solve the above described problems and a concrete point of the invention is to provide a knitted-in slide fastener in which when end portions of the fastener element row of the fastener stringer are mounted directly to clothes by sewing, no fraying occurs in yarns even if knitting yarn, which composes the fastener element mounting portion of the fastener tape, is cut out due to the interference with a sewing needle so that the fastener element row is not separated from the fastener tape at that portion, thereby ensuring an excellent durability.

Especially, because according to the invention, part of the composition yarns of the fastener element mounting portion is composed of composite fiber yarns formed of the heat shrinkage fiber material and the heat fusion fiber material, when heat treatment is carried out after knitting, the heat shrinkage fiber material of the fastener element mounting portion shrinks largely in the longitudinal direction even if the knitting density is set to ordinary density, so that the fastener element mounting portion is formed fine at a high density. Further, tightening force to the fastener element is increased, so that the fastener element row can be fixed firmly to the fastener tape.

Further, according to the structure described above, if the fastener stringer is heat-treated at a higher temperature than the melting point of the heat fusion fiber material, part or all of the heat fusion fiber material is melted at the same time when the heat shrinkage fiber material shrinks, so that it may be fused with the heat shrinkage fiber material and at the same time, also fused with other composition yarns in the vicinity of the fastener element mounting portion.

By cooling this, the melted portion of the heat fusion fiber material is fused with at least the heat shrinkage fiber material and integrated therewith. Thus, even if the heat shrinkage fiber or other composition yarn happens to be cut out with such a situation that the composition yarn of the fastener element mounting portion interferes with the sewing needle when the end portion of the knitted-in slide fastener of the invention is mounted to clothes, fraying in yarn is blocked by this fusion portion because the cut yarn is fused with other yarn through the aforementioned heat fusion fiber material. Further, no further fraying in yarn occurs and then, separation of the fastener element row is not generated while a knitting pattern is maintained.

Further, when said heat fusion fiber material is melted, it is fused with not only the aforementioned yarn but also a portion in contact with the heat fusion fiber material of the element, at the same time. Thus, the fixing of the fastener elements to the fastener tape not only depends upon sandwiching of the upper and lower leg portions by the fixing knitting yarns from the front and rear sides thereof, but also is fastened and stabilized by integration of the composition yarns and the fastener elements through the heat fusion fiber material.

The fastener element mounting portion is formed continuously with the fastener tape main body. That knitting structure utilizes knitting yarns for connecting the fixing knitting yarns with a knitting pattern and various kinds of in-laid yarns to be inserted through the knitting pattern of the fixing knitting yarn as well as the fixing knitting yarns of the fastener element. The typical knitting pattern structure of the fixing knitting yarn includes the chain knitting, tricot knitting, two needle stitch and the like. These knitting pattern structures are knitted independently or in combination. The various kinds of the in-laid yarns include warp in-laid yarn and weft in-laid yarn. The composition yarns in the fastener element mounting portion of the invention contains the fixing knitting yarns and various kinds of the in-laid yarns. Therefore, said composite fiber yarn in the invention is any one of them but not restricted to any special one.

Furthermore, according to the invention, the above-mentioned composite fiber yarn is the fixing knitting yarn and the fixing knitting yarn is the chain knitting yarn. Because one chain knitting pattern is composed of the knitting yarn of two needle loops, if the chain knitting yarn is employed as the fixing knitting yarn of the fastener element row, two knitting yarns of the needle loop stride over the upper leg portion of the fastener element while a knitting yarn of its sinker loop is disposed below the lower leg portion such that it intersects perpendicularly, so as to sandwich and fix the upper and lower leg portions with respective knitting yarns. Therefore, its tightening force is very strong as compared to the other fixing knitting pattern structure. Employing the chain knitting yarn as the fixing knitting yarn as well as a decreased elongation in the direction of the wale based on the structure of the knitting pattern thereof is preferable for stabilizing the fixing of the fastener element when it is intended to knit the fastener elements into the fastener tape.

This chain knitting structure produces little elongation in a direction of wale as described above, and further, if the chain knitting structure is employed as an element fixing structure, a larger tension than that of an ordinary knitting is generated in the chain knitting yarns after knitting. There is such an inclination for non-shrinkable yarns such as ordinary cotton yarn and synthetic fiber yarn. However, since the heat shrinkage fiber material is used as the chain knitting yarn in the invention, after shrinking, a larger tension is generated so that a strong tension is applied in a slide fastener which is a final product.

When the end portion of the fastener element row of the knitted-in slide fastener is mounted to clothes by sewing with this condition, the yarn, which most often interferes with a sewing needle and is cut out, of the composition yarns in the fastener element mounting portion is often the aforementioned fixing chain knitting yarn which is exposed on a surface of the fastener element under a strong tension.

According to the invention, as described above, the composite fiber yarn formed of the heat shrinkage fiber material and the heat fusion fiber material is employed as the fixing chain knitting yarn and then, by heating this, the heat shrinkage fiber material is allowed to shrink in the direction of the yarn and at the same time, the heat fusion fiber material is fused so that the heat shrinkage fiber is fused and integrated with the composition yarns in the vicinity of the fastener element mounting portion. With this fusing, when it is intended to mount the end portion of the fastener element row directly to any mounted object such as clothes by sewing, even if the sewing needle is pierced into the fixing chain yarn and the yarn is cut out at that portion, no fraying occurs in the yarn because the cut-out chain knitting yarn is fused with the other composition yarns, so that the fastener element row is never separated from the fastener tape.

Further, the feature of the invention is that the warp in-laid yarn which is entangled with the sinker loop of the fixing chain knitting yarn is the composite fiber yarn and the feature of the invention according to claim 4 is that the weft in-laid yarns which are to be inserted between the sinker loop and needle loop of the fixing chain knitting yarn are the composite fiber yarns. In this case, only the warp in-laid yarn or the weft in-laid yarn may be the composite fiber yarn and of course, the fixing chain knitting yarns other than the warp in-laid yarn and weft in-laid yarn or other fixing knitting yarn, or other composition yarn of the fastener element mounting portion may be partly of the composite fiber yarn.

Furthermore, according to the invention, the heat fusion fiber material may be composed of fiber having a core/sheath structure and the sheath thereof is composed of the heat fusion material. Further, the heat fusion fiber material may be composed of fiber yarn having a side-by-side structure and part of the composition fiber material disposed inside and outside thereof is composed of the heat fusion fiber material.

Then, in case of the fiber in the core/sheath structure, the sheath and in case of the fiber in the side-by-side structure, part of the composition fiber material disposed inside and outside thereof is formed of the heat fusion fiber material. Therefore, if this heat fusion fiber material is melted, that heat fusion fiber material is fused between the aforementioned heat shrinkage fiber material and the fixing knitting yarn in the fastener element mounting portion or other composition yarns, so that the same function as the above-described one is exerted.

Further, according to the invention, a yarn structure of the composite fiber yarn composed of the heat shrinkage fiber material and the heat fusion fiber material may be employed. This composite fiber yarn may be of a blended yarn of the heat shrinkage fiber and the heat fusion fiber. However, in this case, the heat fusion fiber is fused with the heat shrinkage fiber when it is melted upon heat treatment. Therefore, it is difficult to expect that not only the yarn itself is hardened, but also it is hardly fused with other composition yarns in the fastener element mounting portion composed of ordinary fiber material and the above-described inconvenience which occurs when it is cut out by the sewing needle is solved.

Therefore, the composite fiber yarn is desired to have such a structure which allows melted heat fusion fiber material to be fused with other yarns around it. Both the heat shrinkage fiber material and the heat fusion fiber material are preferred to be of mono-filament or multi-filament made of thermoplastic resin. Usually, as mentioned by the invention of claim 7, the composite fiber yarn is composed of a twisted yarn having a small number of twists formed of fiber yarn made of the heat shrinkage fiber material and the fiber yarn made of the heat fusion fiber material.

Alternatively, the composite fiber yarn itself employs the core/sheath structure and the core yarn is composed of the heat shrinkage fiber material while the sheath yarn is composed of the heat fusion material. Further, such as the invention according to claim 9, the composite fiber yarn itself employs the side-by-side structure formed of the heat shrinkage fiber material and heat fusion fiber material.

With such a structure, as described above, the density of the fastener element mounting portion is increased so that the configuration thereof is stabilized and the mounting strength of the elements is improved. By fusing the composition yarns of the fastener element mounting portion with each other with the heat fusion fiber material, even if part of the composition yarns in the fastener element mounting portion is cut out by a sewing needle when an end portion of the fastener element row in the slide fastener which is a final product is fixed directly to a mounted object such as clothes by sewing, separation of the fastener element row from the fastener tape is prevented.

DESCRIPTION OF THE PREFERRED EMBODIMENTS (First Embodiment)

Figure 1:
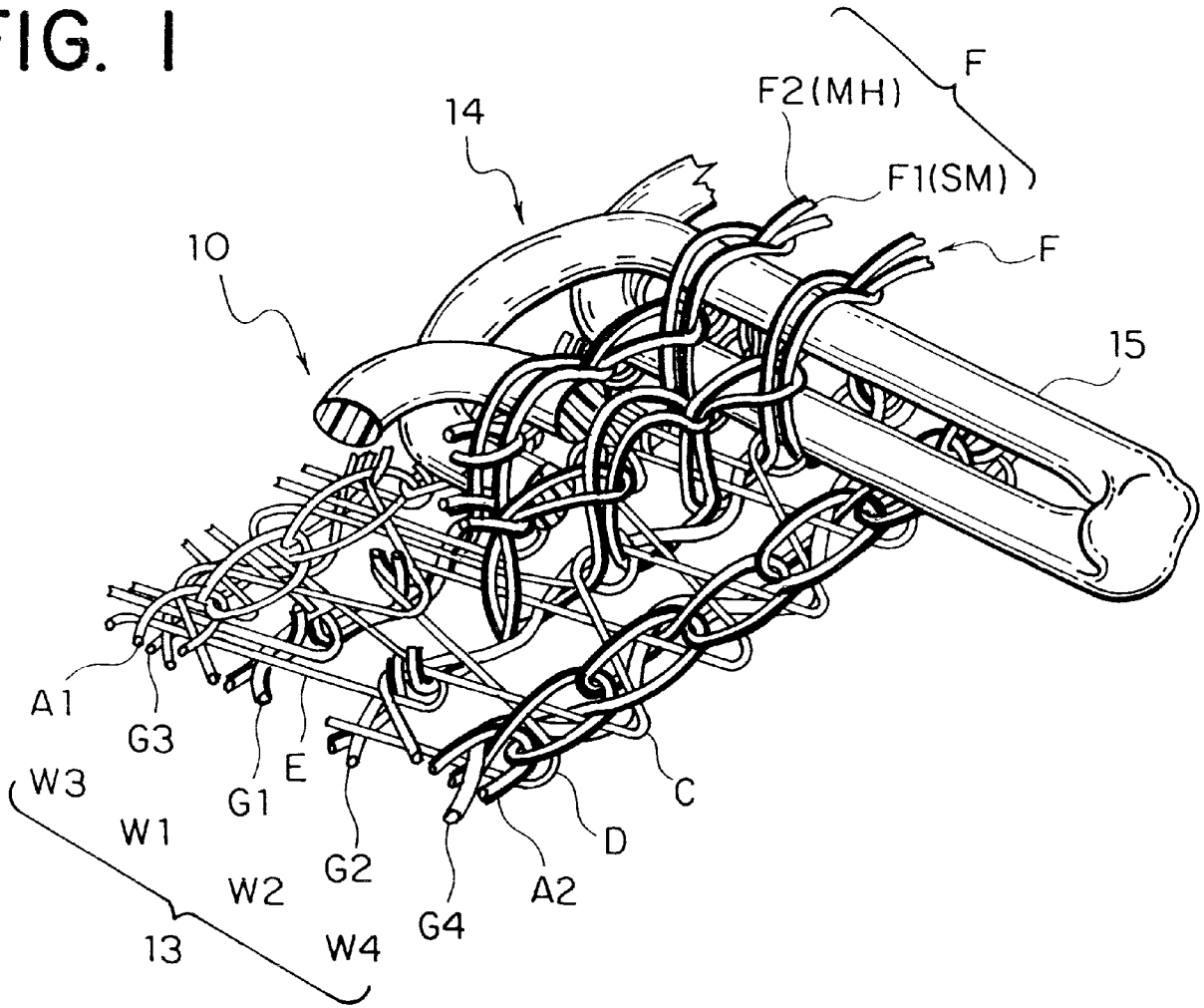
FIG. 1 is a partial perspective view of a fastener element mounting portion of a knitted-in slide fastener seen from the front side thereof, showing a first embodiment of the invention schematically.
Figure 2:
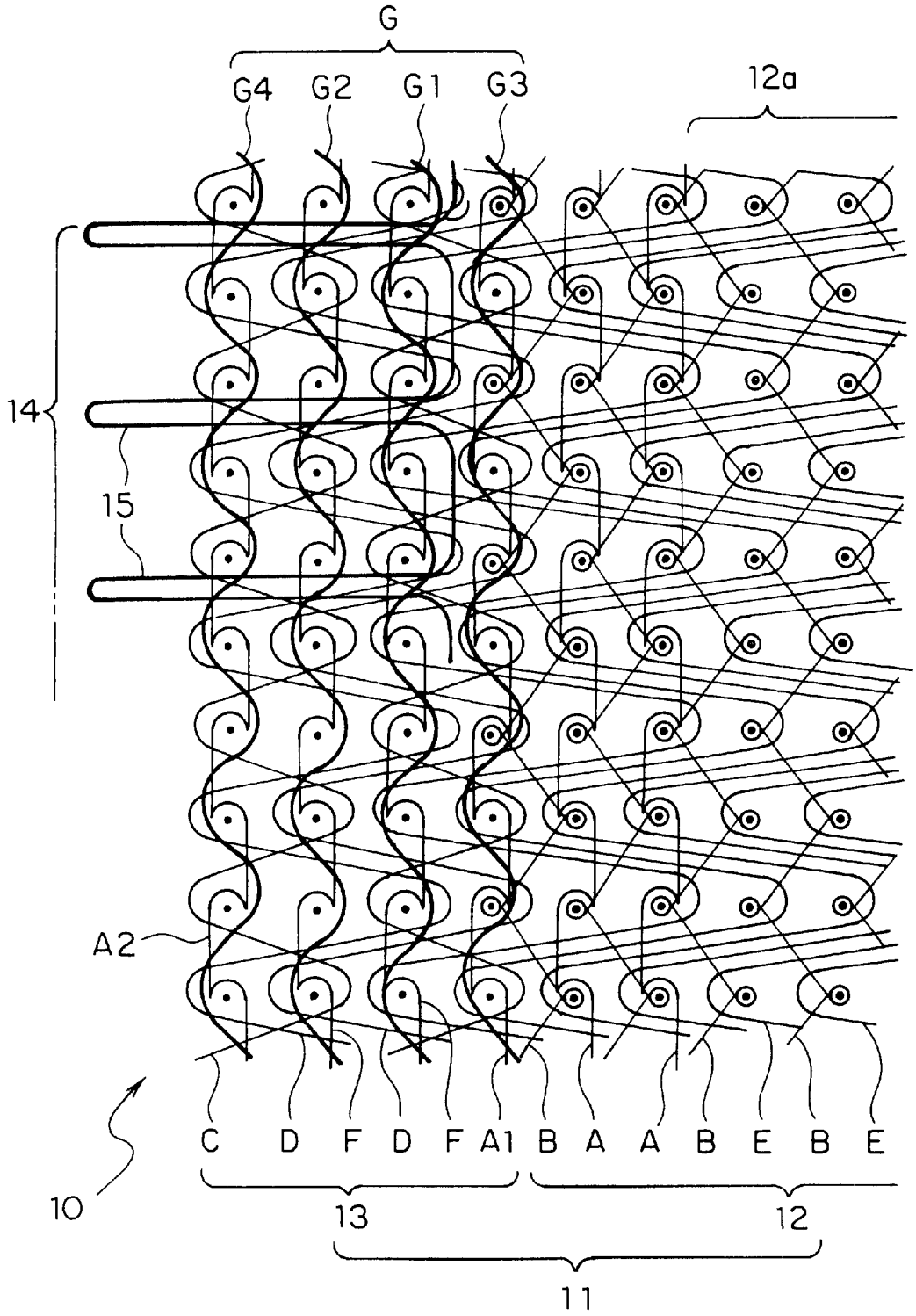
FIG. 2 is an entire structure diagram of the knitted-in slide fastener of FIG. 1.
Figure 3:
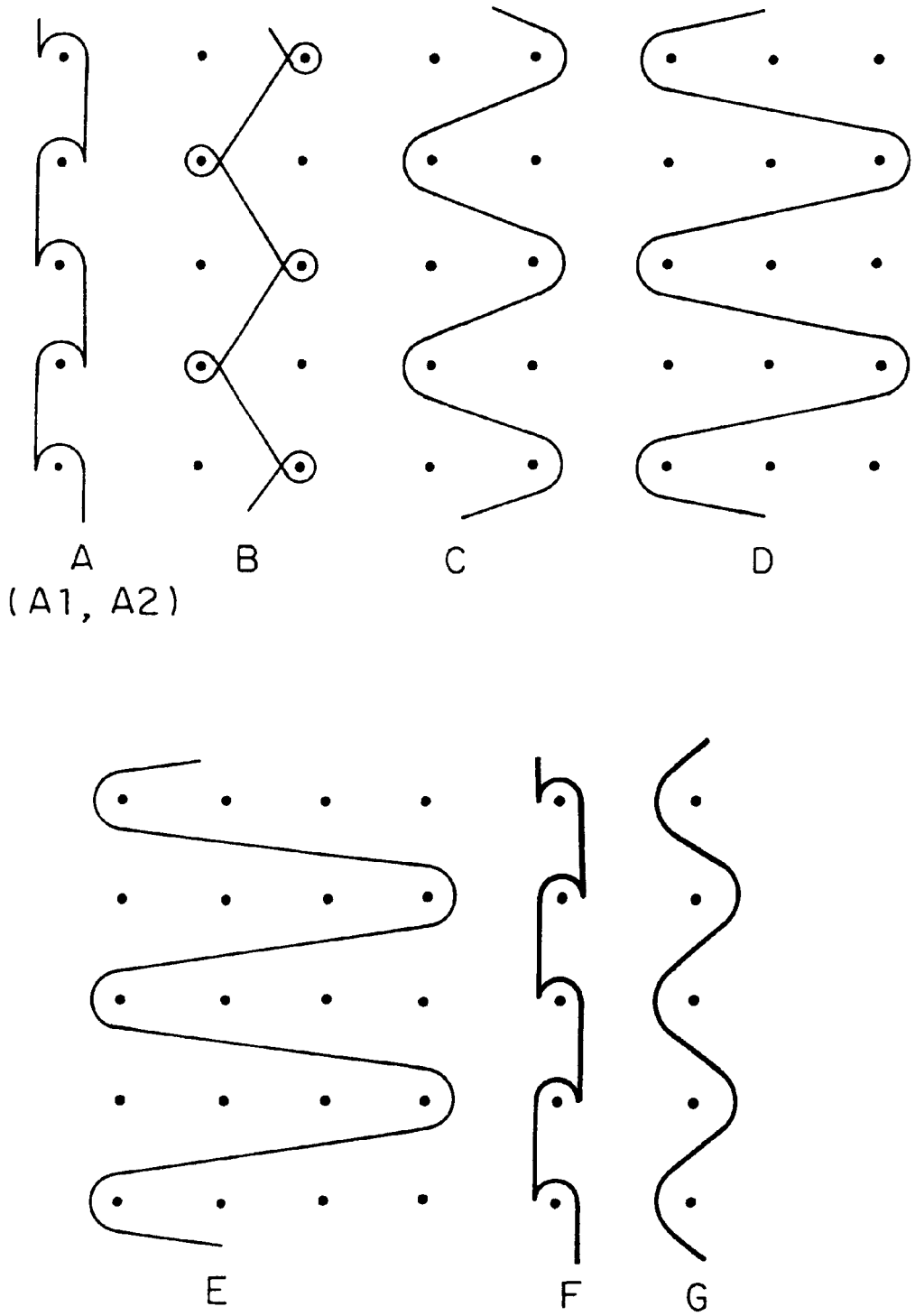
FIG. 3 is a structure diagram of each knitting yarn in the knitted-in slide fastener of FIG. 1.

Hereinafter, the preferred embodiments of the invention will be described concretely based on examples indicated in drawings. FIGS. 1 to 3 show a first embodiment of the invention, while FIG. 1 is a perspective view of a front side of part of a knitted-in slide fastener showing schematically mounting condition of a continuous fastener element row, FIG. 2 is an entire warp knitting structure diagram showing the same slide fastener with omitting part thereof and FIG. 3 is a warp knitting structure diagram of each knitting yarn in the same slide fastener.

Meanwhile, although FIG. 1 shows condition in which the fastener element mounting portion is shown as the center of the figure while omitting its fastener tape main portion and respective knitting yarns are loose to facilitate understanding thereof, it will be understood that actually knit patterns and entangling portions of the respective knitting yarns are finely tightened. Further, although the knitting yarns having various kinds of sizes are indicated in the same Figure in order to help its understanding easily and actually, the size of each yarn may be selected arbitrarily considering the function as the knitted-in slide fastener and formation of the knit pattern. These matters are the same about other embodiments shown in FIGS. 6 and 7.

Although other embodiments than the first embodiment will be described with the same knitting structure as that of the first embodiment, the present invention is not restricted to this knitting structure. Even if diversified knitting structures as shown in FIGS. 6 to 11 mentioned in Japanese Patent Application Laid-Open No. 11-187909 are applied or double knitting structure is utilized as well as single knitting structure, naturally, the present invention can apply those knitting structures. Further, continuous fastener element row made of synthetic resin mono-filament, as well as the knitting structure, is not restricted to a coil shape as shown in the same Figure but may be constructed such that it is folded back in a zigzag shape. A fastener stringer 10 according to the first embodiment has a single-knitting structure formed with a general warp-knitting machine having a row of needle bed as understood with reference to FIGS. 1 to 3.

A foundation structure of a fastener tape main body 12 according to this embodiment is composed of knitting yarns formed of polyester base synthetic fiber. A chain knitting yarn (A) shown in FIGS. 2 and 3 has a chain knitting structure of 0-1/1-0, a tricot knitting yarn (B) has a tricot knitting structure of 1-0/1-2 and three kinds of weft in-laid yarns (C), (D) and (E) are respectively inserted in zigzag shape in the width direction of the fastener tape 11 with the same knitting structure of 0-0/2-2, 3-3/0-0, 4-4/0-0.

According to this embodiment, said chain knitting yarn (A) is omitted in the knitting structure located at an intermediate position 12*a* of the fastener tape main body 12 as shown in FIG. 2 so as to provide the intermediate portion 12*a* with plasticity to fit well to a mounted object such as clothes, thereby facilitating and securing the mounting of the slide fastener. Of course, the intermediate portion 12*a* of the fastener tape main body 12 may be formed with the chain knitting yarn (A) like other portions without omitting the chain knitting yarn (A) or it is permissible to use the chain knitting yarn (A) with knitting yarns of other knitting structure. The composition yarn of the foundation structure of the fastener tape main body 12 may employ synthetic fiber material such as polyamide base and polypropylene as well as polyester base synthetic fiber material independently or in combination.

According to this embodiment, four wales on a side edge in the longitudinal direction of the fastener tape 11 serve as a fastener element mounting portion 13 and in the fastener element mounting portion 13, coil-like mono-filament of nylon 6 or nylon 66 is reciprocated in the width direction of the fastener tape 11 within the same course of every other course so that the mono-filament is woven into the mounting portion 13 so as to form a fastener element row 14. This fastener element row 14 is knitted into the fastener element mounting portion 13 at every other course with fixing chain knitting yarn (F) of two wales knitted with the same chain knitting structure 0-1/1-0 in the fastener element mounting portion 13 at the same time when the coil-like fastener element row 14 is formed, so that the fastener element row is mounted and fixed continuously.

Meanwhile, as shown in FIGS. 1 to 3, with this fixing chain knitting yarn (F), its needle loop is formed in the longitudinal direction of the fastener element row 14 such that it strides over an upper side of the a portion of each element 15 and the fastener element row is pressed down from its upper side with each needle loop group continuous in a wale direction and fixed to the fastener element mounting portion 13. At this time, the sinker loop is located below each leg portion of the fastener element row 14 so as to form each sinker loop group continuous in the wale direction, thereby forming part of the foundation structure of the fastener element mounting portion 13 in which the fastener element row 14 is placed.

According to this embodiment, warp in-laid yarns (G1, G2) are entangled with and inserted into successively all the sinker loops of each sinker loop group of the two fixing chain knitting yarns (F) under the knitting structure of 1-1/0-0, and knitted into the foundation structure of the fastener element mounting portion 13. In the meantime, according to the first embodiment, as shown in FIGS. 1 and 3, in addition to the warp in-laid yarns (G1, G2) which are the fixing chain knitting yarns (F) for the two wales W1, W2, the respective warp in-laid yarns (G3, G4) are inserted along the chain knitting yarns (A1, A2) which are composition yarns of respective wales W3, W4 in a zigzag shape.

Consequently, the entire foundation structure of the fastener element mounting portion 13 is provided with feeling and configuration like woven fabric and stabilized dimensionally in the longitudinal/transverse directions so that the fastener element row 14 can be fixed more stably.

In the meantime, these warp in-laid yarns (G1 to G4) may be inserted into only the fixing chain knitting yarn (F) of the fastener element row 14 or each of chain knitting yarns composing the three wales including the outermost wale in the fastener tape 11 opposite to the fastener element mounting portion 13. Therefore, the indicated example shows only one aspect of this embodiment and it could be understood that this embodiment includes various modifications.

In the above-described knitting structure, it is important to use composite fiber yarn composed of heat shrinkage fiber material (SM) and heat fusion fiber material (MM) for part of the composition yarns which compose the fastener element mounting portion 13.

According to the first embodiment, as shown in FIG. 1, of the composition fiber yarns of the fastener element mounting portion 13, the chain knitting yarn (F) which is a fixing yarn for fixing the fastener element row 14 to the fastener tape 11 is composed of the aforementioned composite fiber yarn.

Figure 4A:
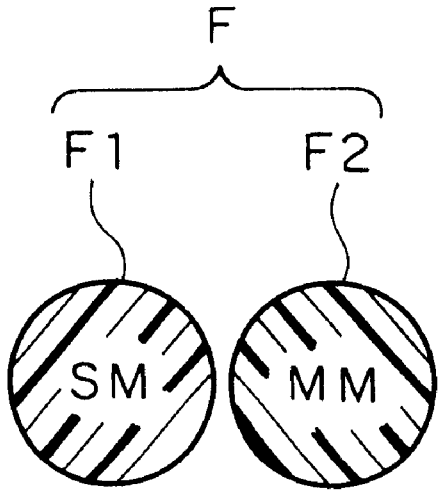
FIG. 4 is a sectional view showing an example of a yarn structure of a composite fiber yarn.

As for the yarn composition of this composite fiber yarn, as shown in FIGS. 1 and 4A, it is comprised of two fiber yarns (F1, F2) and one thereof is composed of the heat shrinkage fiber material (SM) while the other one is composed of the heat fusion fiber material (MM). Although according to this embodiment, the heat shrinkage fiber material (SM) and heat fusion fiber material (MM) both utilize the same polyester base synthetic resin material, their melting points are different and it is considered that the melting point of the heat shrinkage fiber material (SM) is higher than that of the heat fusion fiber material (MM). Although other synthetic fiber material may be used, preferably both of them are composed of the same base synthetic fiber material in order to obtain an excellent fusion performance.

Although according to this embodiment, the two fiber yarns (F1, F2) may be used as double yarns which are placed just in parallel as shown in FIG. 4A, it is preferable that light twisting is applied to the two fiber yarns (F1, F2) to facilitate their treat upon knitting.

Figure 4B:
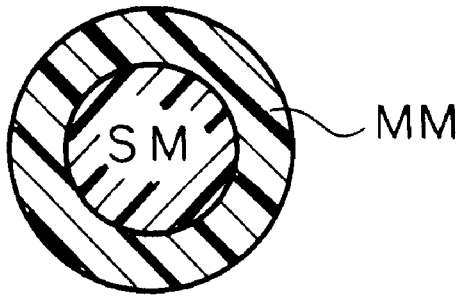
Figure 4C:
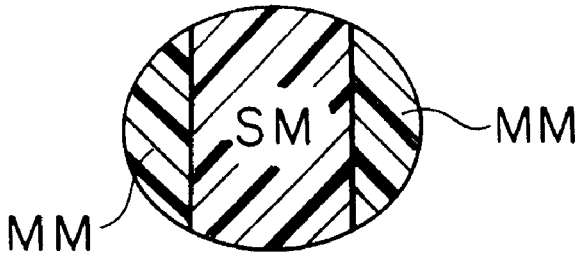

As the yarn composition of the composite fiber material, in addition to the structure shown in FIG. 4A, it is permissible to employ a core/sheath structure or a side-by-side structure as shown in FIGS. 4B and 4C. The core/sheath structure mentioned here refers to a yarn structure formed integrally such that the center portion thereof is a core while that core is enclosed in the form of a sheath. The side-by-side structure mentioned here refers to a yarn structure formed integrally such that the synthetic fiber materials of different substances are sandwiched in the size direction. If the core/sheath structure is employed as the composite fiber yarn in the invention, the heat shrinkage fiber material (SM) is used as its core while the heat fusion fiber material (MM) is used as its sheath. Alternately, if the side-by-side structure is employed, preferably the outside fiber material is composed of the heat fusion fiber material (MM) because it can be fused much more with other composition yarns of the fastener element mounting portion 13.

The point of the invention which much attention should be paid is composite ratio between the heat shrinkage fiber material (SM) and the heat fusion fiber material (MM), which are the composition materials of the fixing chain yarn (F) as the composite fiber yarn. Although this value cannot be uniformly determined depending upon knitting conditions such as knitting density, knitting structure, size of yarns, knitting velocity, material of the yarns and the like, the independent yarn strength of the heat shrinkage fiber material (SM) after shrinkage needs to be sufficient enough for being provided with a conventional yarn strength with the heat fusion fiber material (MM) being fused with other fiber yarns by its fusion.

Further, according to this embodiment, heat shrinkage ratio of the warp in-laid yarns (G1 to G4) in the fastener element mounting portion 13 (G1 to G4), chain knitting yarns (A1, A2), weft in-laid yarns (C), (D) and chain knitting yarn (A) in the fastener tape main body 12 adjacent to the fastener element mounting portion 13 other than the fixing chain knitting yarn (F) is set to be higher than the heat shrinkage ratio of the tricot knitting yarn (B) and the weft in-laid yarn (E) which are composition yarns of the intermediate portion 12*a* of the fastener tape main body 12. Further, the heat shrinkage ratio of the warp in-laid yarns (G1 to G4) is set to be higher than that of the fixing chain knitting yarn (F), chain knitting yarns (A1, A2) and weft in-laid yarns (C), (D), which are other composition yarns of the fastener element mounting portion 13.

If explaining with concrete numerical values, the dry heat shrinkage ratio of the warp in-laid yarns (G1 to G4) of 100 to 150 denier in the composition yarns of the fastener element mounting portion 13 is set in a range of 15 to 40%, preferably 20 to 30%. The heat shrinkage fiber material (SM) of the fixing chain knitting yarn (F), which is the composite fiber yarn, the chain knitting yarns (A1, A2) and the weft in-laid yarns (C), (D) have 100 to 350 denier and their dry heat shrinkage ratio is set 10 to 30%, preferably 10 to 15%. The chain knitting yarn (A), the tricot knitting yarn (B) and the weft in-laid yarn (E), which are composition yarns of the fastener tape main body 12, have 100 to 300 denier and their dry heat shrinkage is set in a range of 3 to 10%, preferably 5 to 8%.

Here, the aforementioned shrinkage ratio is determined by substance of fiber or filament, extension magnification upon being stretched and setting temperature thereof. Generally, high shrinkage yarn has a low extension magnification and setting temperature and its crystallization density is low, so that its strength is low and stretching degree is high. On the other hand, an ordinary yarn that is used often generally has a high extension magnification and set up at high temperatures in its stretched condition, so that the degree of crystallization is raised. Thus, the strength is increased and the shrinkage ratio is lowered.

If the respective heat shrinkage ratios of the composition yarns of the fastener element mounting portion 13 and the composition yarns of the fastener tape main body 12 are set up as described above in the knitted-in slide fastener in which the synthetic resin fastener element row 14 is knitted at the same time when the fastener tape 11 is knitted, in the case that the heat treatment is carried out when the knitting density is set up to an ordinary density, the composition yarns of the fastener element mounting portion 13 shrink more than the composition yarns of the fastener tape main body 12. Therefore, the knitting density of the fastener element mounting portion 13 is increased so that the knitting pattern becomes fine. Consequently, feeling of woven fabric based on the above-described weaving structure is secured and its configuration is further stabilized. Additionally, the fastener element row 14 is tightened much more firmly with the fixing chain knitting yarn (F), so that even when the fastener stringer 10 is bent strongly in the face direction of the tape, separation of coupling never occurs, thereby securing a strong coupling strength.

Further, because the fastener stringer 10, which is an ordinary knitted product, includes the fastener element row 14, the length of the fastener element mounting portion 13 is set longer than that of the fastener tape main body 12. Consequently, the fastener stringer 10 is entirely curved in the form of arc such that the fastener element row 14 is protruded outward into the same plane. However, because the shrinkage of the fastener element mounting portion 13 is larger than that of the fastener tape main body 12, the fastener stringer becomes almost straight or the fastener element row 14 is curved slightly inward in a concave shape by the heat shrinkage treatment.

The most prominent point of this embodiment is that when heat treatment is carried out on the knitted fastener stringer 10, not only the fixing chain knitting yarn (F) in the fastener element mounting portion 13 shrinks, but also the heat fusion fiber material (MM) thereof is melted, so that it is fused with the heat shrinkage fiber material (SM), its surrounding warp in-laid yarns (G1 to G4) and weft in-laid yarns (C), (D). Consequently, the fixing chain yarn (F) may be fused integrally with the surrounding warp in-laid yarns (G1 to G4) and part of the weft in-laid yarns (C), (D).

As a result, the composition yarns in the fastener element mounting portion 13 after producing the fastener stringer 10 are fused integrally with part of the surrounding yarns around the fixing chain knitting yarn (F). Thus, when a slide fastener not provided with upper or lower stop, which is a final product, is attached to an opening portion of the trousers, skirt or the like, even if the fixing chain knitting yarn (F) of the fastener element row 14 is cut out because a sewing needle is pierced into the fixing chain knitting yarn (F) when both end portions in the longitudinal direction of the fastener element row 14 are sewed to end portions of the opening portion, fraying of the yarns is blocked because the fixing chain knitting yarn (F) is fused integrally with the composition yarns (G1 to G4) around the fastener element mounting portion 13 and the weft in-laid yarns (C), (D). As a result, the fixing strength to the individual fastener element 15 is maintained. Consequently, the fastener element row 14 is never separated from the fastener tape 11 due to fraying of the yarns.

Meanwhile, the composite fiber yarn of this embodiment is composed of the fiber yarn (F1) formed of the heat shrinkage fiber material (SM) and the fiber yarn (F2) formed of the heat fusion fiber material (MM) as described above. Although the fiber yarn (F2) formed of the heat fusion fiber material (MM) can be all composed of the heat fusion fiber material (MM) like this embodiment, it is permissible to apply the core/sheath structure or the side-by-side structure as shown in FIGS. 5A and 5B.

Figure 5A:
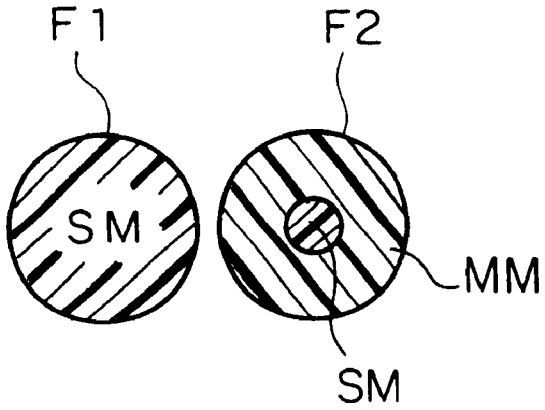
FIG. 5 is a sectional view showing an example of modification of a heat fusion fiber material which is one component of the composite fiber yarn of the invention.
Figure 5B:
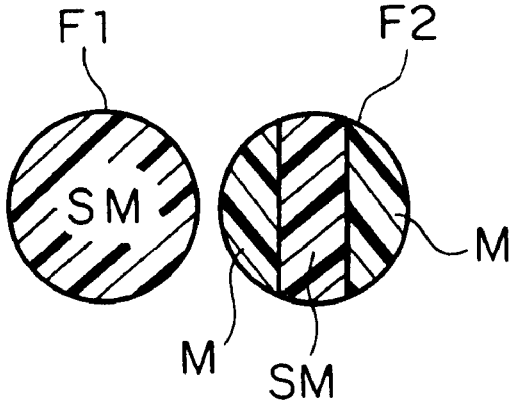

That is, in case of the core/sheath structure shown in FIG. 5A, the heat shrinkage or ordinary synthetic fiber may be used for the core while the heat fusion fiber material (MM) may be used for the sheath. In case of the side-by-side structure shown in FIG. 5B, the substance of fiber disposed outside may be composed of the heat fusion fiber material (MM) while the substance of fiber sandwiched therebetween may be composed of the heat shrinkage fiber material (SM) or ordinary synthetic fiber material. If the heat shrinkage fiber material (SM) is employed for the core/sheath structure or the side-by-side structure as mentioned above, it is preferable to use fiber material, with which a sufficient strength as the fixing knitting yarn can be obtained easily, and having the same shrinkage ratio as the aforementioned fiber yarn (F1) composed of the heat shrinkage fiber material (SM) in the composite fiber yarn, because part of the yarn is left when the fiber yarn (F2) composed of the heat fusion fiber material (MM) is melted.

(Second Embodiment)

Figure 6:
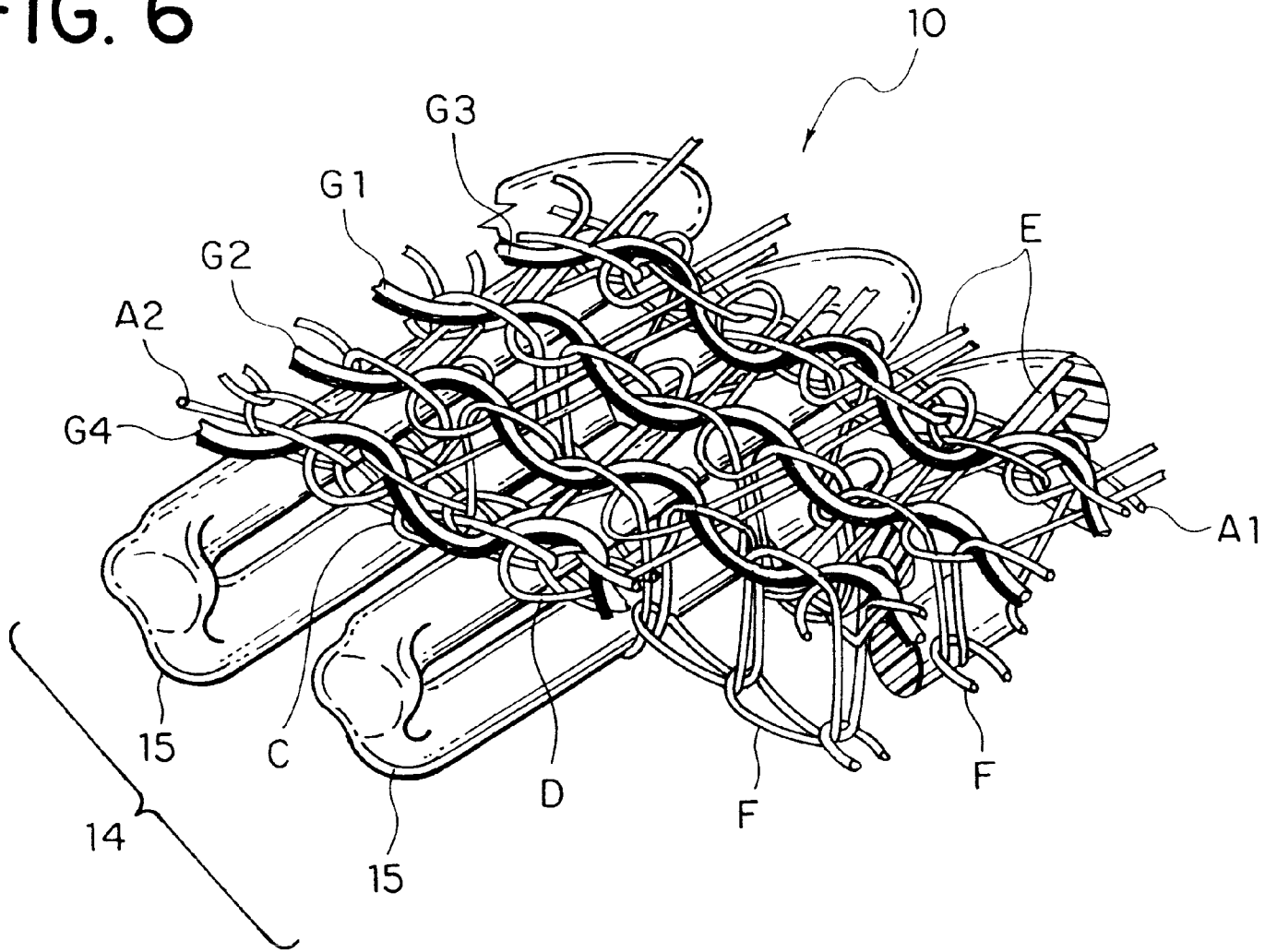
FIG. 6 is a partial perspective view of a fastener element mounting portion of a knitted-in slide fastener seen from the rear side thereof, showing a second embodiment schematically.

FIG. 6 shows a second embodiment of the invention and the knitting structure of its fastener stringer 10 is the same as that of the first embodiment. However, according to this embodiment, the fixing chain knitting yarn (F) is not composed of the composite fiber yarn but the ordinary synthetic fiber material. And all the warp in-laid yarns (G1 to G4) of the fastener element mounting portion 13 are composite fiber yarns composed of the heat shrinkage fiber material (SM) and the heat fusion fiber material (MM). According to this embodiment also, the fixing chain knitting yarn (F) may be composed of the same composite fiber yarn as the warp in-laid yarns (G1 to G4) like the first embodiment. The function is substantially the same as that of the first embodiment.

(Third Embodiment)

Figure 7:
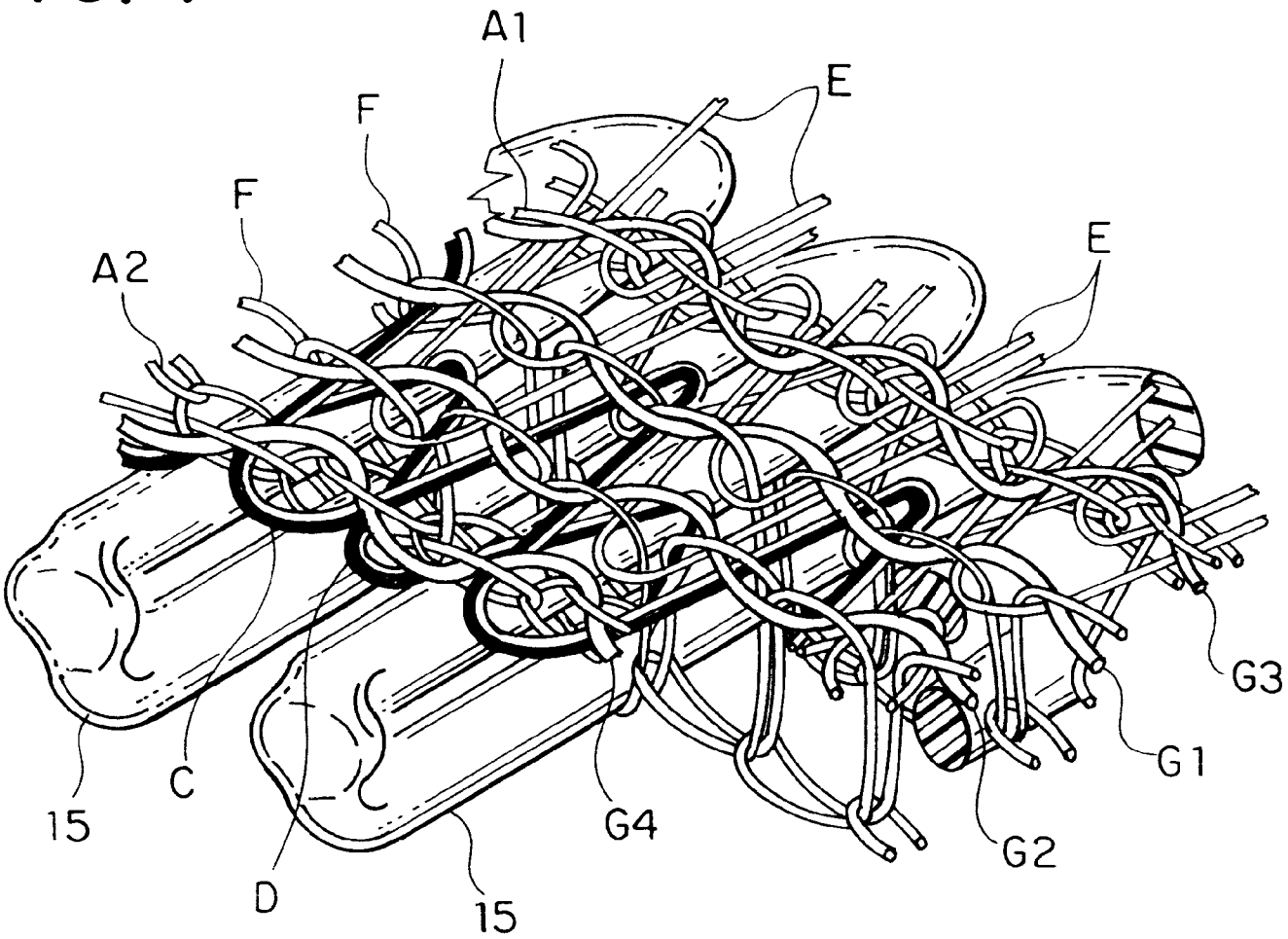
FIG. 7 is a partial perspective view of a fastener element mounting portion of a knitted-in slide fastener seen from the rear side thereof, showing a third embodiment schematically.

FIG. 7 shows a third embodiment of the invention. The knitting structure of this fastener stringer 10 is the same as that of the first embodiment. However, according to this embodiment also, the fixing chain knitting yarn (F) is composed of ordinary fiber yarn while the weft in-laid yarns (C) and (D), which are the composition yarns of the fastener element mounting portion 13 are composed of composite fiber yarns of the invention, which are formed of the heat shrinkage fiber material (SM) and the heat fusion fiber material (MM). According to this embodiment also, the fixing chain knitting yarn (F) may be composed of the composite fiber yarn like the first embodiment and in this case, the composite fiber yarn may be of the same material as the weft in-laid yarns (C) and (D). Its function is substantially the same as those of the first and second embodiments.

Further, all of the fixing chain knitting yarn (F), the warp in-laid yarns (G1 to G4) and the weft in-laid yarns (C) and (D) may be composed of the composite fiber yarns, which are formed of the heat shrinkage fiber material (SM) and the heat fusion fiber material (MM).

Although various kinds of the embodiments have been described above, it is evident from the above description that the invention is not restricted to these embodiments. For example, although the size of each knitting yarn composing the foundation structure of each embodiment can be selected arbitrarily depending upon necessity, the same thing can be said of the warp in-laid yarn (G) and the size of the warp in-laid yarn (G4) to be inserted into the chain knitting yarn (A2) disposed nearest a coupling head of the fastener element of each embodiment may be thicker than that of the warp in-laid yarns (G1, G2) to be inserted into the fixing chain knitting yarn (F) disposed inside thereof. In this case, a end edge portion of the fastener element mounting portion is formed thick, so that it is sufficiently resistant to upward folding or pushing relative to the fastener surface, thereby making it possible to suppress separation of coupling of the fastener elements.

What is claimed is:

1. A knitted-in slide fastener comprising a continuous fastener element row which is knitted in at a fastener element mounting portion on a side edge portion in a longitudinal direction of a warp knitted fastener tape at the same time as knitting of the fastener tape, wherein said fastener element mounting portion is composed of a fixing knitting yarn and other knitting yarns for sandwiching and fixing upper and lower leg portions of each fastener element in a direction of front and rear of the fastener tape, part of these composition yarns is composed of a composite fiber yarn formed of heat shrinkage fiber material and heat fusion fiber material (MM), and said heat fusion fiber material is fused to other said composition yarns in the vicinity thereof.

2. A knitted-in slide fastener according to claim 1, wherein said fixing knitting yarn includes a chain knitting yarn and this fixing chain knitting yarn is said composite fiber yarn.

3. A knitted-in slide fastener according to claim 1, wherein said fixing knitting yarn includes a chain knitting yarn and each of warp in-laid yarns which is entangled with a sinker loop of the fixing chain knitting yarn is said composite fiber yarn.

4. A knitted-in slide fastener according to claim 1, wherein said fixing knitting yarn includes a chain knitting yarn and each of weft in-laid yarns which are respectively to be inserted between a sinker loop and a needle loop of the fixing chain knitting yarn is said composite fiber yarn.

5. A knitted-in slide fastener according to claim 1, wherein said fixing knitting yarn includes a chain knitting yarn, and at least one of warp in-laid yarns being entangled with a sinker loop of the fixing chain knitting yarn and weft in-laid yarns respectively being inserted between a sinker loop and a needle loop of the fixing chain knitting yarn and the chain knitting yarn are composite fiber yarns.

6. A knitted-in slide fastener according to claim 1, wherein said heat fusion fiber material is composed of fiber having a core/sheath structure and a sheath thereof is composed of the heat fusion material while a core is composed of synthetic fiber material.

7. A knitted-in slide fastener according to claim 1, wherein said heat fusion fiber material is composed of fiber having a side-by-side structure and composition fiber disposed outside thereof is composed of the heat fusion fiber material while other composition fiber is composed of synthetic fiber material.

8. A knitted-in slide fastener according to claim 1, wherein composite fiber yarns are formed of at least two kinds of fiber yarns and one of the fiber yarns is formed of said heat shrinkage fiber material while the other fiber yarn is formed of the heat fusion fiber material.

9. A knitted-in slide fastener according to claim 1, wherein said composite fiber yarn has a core/sheath structure and a core thereof is composed of said heat shrinkage fiber material while a sheath thereof is composed of said heat fusion material.

10. A knitted-in slide fastener according to claim 1, wherein said composite fiber yarn has the side-by-side structure formed of said heat shrinkage fiber material and said heat fusion fiber material.

* * * * *